US010550508B2

(12) United States Patent
Perry et al.

(10) Patent No.: US 10,550,508 B2
(45) Date of Patent: Feb. 4, 2020

(54) PORTABLE, UNATTENDED HEATING DEVICE FOR STAIN TREATMENT PAD

(71) Applicant: BISSELL Homecare, Inc., Grand Rapids, MI (US)

(72) Inventors: Joseph P. Perry, Comstock Park, MI (US); Jay M. Kellis, Grand Rapids, MI (US); Michael Luyckx, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 282 days.

(21) Appl. No.: 15/616,313

(22) Filed: Jun. 7, 2017

(65) Prior Publication Data

US 2017/0356121 A1 Dec. 14, 2017

Related U.S. Application Data

(60) Provisional application No. 62/347,847, filed on Jun. 9, 2016.

(51) Int. Cl.
*D06F 43/00* (2006.01)
*A47L 13/17* (2006.01)
(Continued)

(52) U.S. Cl.
CPC ..... *D06F 43/002* (2013.01); *A47L 13/17* (2013.01); *A47L 13/50* (2013.01); *A47L 25/00* (2013.01); *B08B 7/0071* (2013.01)

(58) Field of Classification Search
CPC ..... A47L 13/17; A47L 13/50; A47L 25/00; A47L 13/225; A47L 11/34; A47L 11/4011; D06F 43/002
(Continued)

(56) References Cited

U.S. PATENT DOCUMENTS 2,224,896 A * 12/1940 Burian ..... D06F 75/40 38/79
2,501,549 A * 3/1950 Swenson ..... D06F 75/40 38/79
(Continued)

FOREIGN PATENT DOCUMENTS

CN 2040344 U 7/1989
CN 104005216 A 4/2016
(Continued)

OTHER PUBLICATIONS

Bissell Stomp 'n Go Pads for Carpet Stain Removal 96Q9W, www.bissell.com/stomp-n-go-pads-for-carpet-stain-removal-96q9w, 2 pages, item accessed Jun. 7, 2017.
(Continued)

*Primary Examiner* — David G Cormier
*Assistant Examiner* — Thomas Bucci
(74) *Attorney, Agent, or Firm* — McGarry Bair PC

(57) ABSTRACT

A system for treating stains on a surface includes a portable, unattended heating device having a housing, a heating plate, and a controller operably coupled with the heating plate, wherein the controller is configured to actuate the heating plate. The system can further include a stain treatment pad wetted with a liquid treating chemistry, and the portable, unattended heating device is adapted to rest on and heat the stain treatment pad to treat a stain, including releasing, transferring and removing the stain from the surface to be cleaned.

19 Claims, 10 Drawing Sheets

(51) Int. Cl.
*A47L 13/50* (2006.01)
*B08B 7/00* (2006.01)
*A47L 25/00* (2006.01)

(58) Field of Classification Search
USPC ..... 68/214, 240, 213, 222, 5 R, 13 R, 5 A; 15/320, 319, 321, 322, 339, 228, 378; 38/79, 77.7, 93, 96, 107, 140
See application file for complete search history.

(56) References Cited

U.S. PATENT DOCUMENTS 2,596,314 A * 5/1952 Wales ..... D06F 75/40 38/79
2,602,247 A * 7/1952 Cochran ..... D06F 75/40 38/79
2,642,682 A * 6/1953 Browning ..... D06F 75/40 38/79
2,664,655 A * 1/1954 Ivar ..... D06F 75/40 38/79
2,668,379 A * 2/1954 Binggely ..... D06F 75/40 38/79
2,712,703 A * 7/1955 Hilldale ..... D06F 75/40 38/79
2,713,222 A * 7/1955 Brace ..... D06F 75/40 38/79
2,713,224 A * 7/1955 Brace ..... D06F 75/40 38/79
2,718,076 A * 9/1955 Brace ..... D06F 75/40 38/79
2,734,294 A * 2/1956 Brace ..... D06F 75/40 38/79
2,749,633 A * 6/1956 Seck ..... D06F 75/40 38/77.7
2,810,216 A * 10/1957 Greer ..... A47L 25/08 38/2
3,050,885 A * 8/1962 Whitfield ..... D06F 75/40 38/79
3,200,521 A * 8/1965 Whitfield ..... D06F 75/40 38/79
4,095,303 A * 6/1978 Armstrong ..... A47L 11/34 15/1.51
4,186,031 A * 1/1980 Armstrong ..... A47L 11/34 134/1
4,651,453 A * 3/1987 Doyle ..... D06F 75/16 219/245
5,707,163 A 1/1998 Gregory
5,721,418 A * 2/1998 Hazan ..... D06F 75/40 219/257
5,966,851 A * 10/1999 Serpa ..... D06F 75/38 38/77.7
6,020,300 A 2/2000 Tcheou et al.
6,105,285 A * 8/2000 Nickel ..... D06F 75/40 38/76
6,233,771 B1 5/2001 Hortel et al.
7,073,226 B1 * 7/2006 Lenkiewicz ..... A47L 11/34 15/320
7,228,589 B2 * 6/2007 Miner ..... A47L 11/34 15/320
7,234,197 B2 * 6/2007 Tran ..... A47L 11/34 15/320
7,507,109 B2 * 3/2009 Tran ..... A47L 11/34 174/153 G
8,549,697 B1 * 10/2013 Moyher, Jr. ..... A47L 11/34 15/319
2002/0178507 A1 12/2002 Goldoni et al.
2003/0019134 A1 * 1/2003 Alipour ..... D06F 75/40 38/79
2003/0056408 A1 * 3/2003 Hecht ..... D06F 75/40 38/96
2006/0048319 A1 3/2006 Morgan et al.
2006/0179599 A1 * 8/2006 Miner ..... A47L 11/34 15/320
2006/0207052 A1 * 9/2006 Tran ..... A47L 11/34 15/320
2007/0224877 A1 * 9/2007 Tran ..... A47L 11/34 439/469
2009/0126145 A1 * 5/2009 D'Agostino ..... A47L 5/28 15/339
2009/0313767 A1 * 12/2009 Tanner ..... D06F 73/00 8/149.3
2010/0024146 A1 * 2/2010 Rosenzweig ..... A47L 13/16 15/228
2010/0037495 A1 * 2/2010 Rosenzweig ..... A47L 11/34 38/77.8
2010/0186268 A1 * 7/2010 Sunder ..... A47L 25/08 38/144
2012/0145191 A1 * 6/2012 Williams ..... A47L 13/17 134/6
2013/0232713 A1 * 9/2013 Luedke ..... A47L 13/225 15/228
2013/0318725 A1 * 12/2013 Kellis ..... A47L 13/225 8/137
2014/0259478 A1 * 9/2014 Conrad ..... A47L 11/4083 15/98
2015/0013098 A1 * 1/2015 Vrdoljak ..... A47L 13/225 15/320
2015/0297054 A1 * 10/2015 Weeks ..... A47L 13/225 134/6

FOREIGN PATENT DOCUMENTS

FR 1227461 A 8/1960
FR 2807933 A 10/2001
KR 20150106593 A 9/2015

OTHER PUBLICATIONS

Safety Data Sheet for Bissel Stomp N' Go Pads, 4 pages, item accessed May 12, 2015.

* cited by examiner

PORTABLE, UNATTENDED HEATING DEVICE FOR STAIN TREATMENT PAD

CROSS-REFERENCE TO RELATED APPLICATION(S)

This application claims the benefit of U.S. Provisional Patent Application No. 62/347,847 filed Jun. 9, 2016, which is incorporated herein by reference in its entirety.

BACKGROUND

Cleaning solutions can be used to treat and/or remove stains from soft surfaces, such as fabrics, carpets, rugs and upholstery. Traditional stain treatment typically requires a user to apply a cleaning solution to a surface to be cleaned, wait some predetermined amount of time and then return to remove the soiled and excess liquid. Application can often require the user to scrub the solution into the surface, and the removal step can involve blotting, wiping, rinsing, vacuuming, or some combination thereof. These steps can be labor intensive and expose the user's hands to the soiled and excess liquid. In addition, some of the solution may evaporate from the surface during these steps, diminishing the effectiveness of the solution. Even despite stain treatment, a stain can reappear after treatment if stain residue remains beneath a visible portion of the surface to be cleaned. For example, in some cases, stain residue can remain in carpet backing or padding. If the stain is not permanently and completely removed, it can wick upwardly and eventually reappear on the surface to be cleaned.

Some cleaning solutions are used in an at least partially automated cleaning operation using various surface cleaning apparatus. For example, extractors or deep cleaners are household devices for deep cleaning carpets and other fabric surfaces, such as upholstery. Most carpet extractors comprise a fluid delivery system and a fluid recovery system. These typically clean large areas, and also require an extended drying time for the cleaned area.

Steam devices such as steam mops and handheld steamers typically include at least one tank for storing water that is fluidly connected to a steam generator which heats the liquid to or above the boiling point of liquid to produce steam. The generated steam is directed towards the surface to be cleaned through a distributor nozzle or a manifold. Steam may be applied directly to the surface to be cleaned, or indirectly by use of a cleaning pad attached to the steam device. While these may offer a reduced drying time, many are only effective for light cleaning, sterilizing, or sanitizing, and are ineffective for stain removal.

BRIEF SUMMARY

In one aspect, the invention relates to a cleaning system including a portable, unattended heating device. The portable, unattended heating device includes a housing, a heating plate adapted to heat to a temperature less than the boiling point of water, and a main controller operably coupled with the heating plate, wherein the main controller is configured to actuate the heating plate to heat to a temperature less than the boiling point of water. The system can further include a stain treatment pad wetted with a liquid treating chemistry, and the portable, unattended heating device is adapted to rest on and heat the stain treatment pad to treat a stain on a surface to be cleaned.

DESCRIPTION OF EMBODIMENTS OF THE INVENTION

The invention generally relates to a treating stains on surfaces. In one aspect, the invention relates to treating stains on surfaces using an unattended cleaning device.

Embodiments of the of the present disclosure an unattended and portable heating device that is configured to heat a pre-wetted stain treatment pad to remove tough, set-in stains from carpet and rugs. The heating device, alternatively referred to herein as a pad heater, can comprise a heating plate for warming the stain treatment pad to add heat energy to the chemical reaction and effectuate the stain release, transfer and removal process. The pad heater and stain treatment pad can form a cleaning system used to treat stains on a surface to be cleaned. The cleaning system can include at least one stain treatment pad, or multiple stain treatment pads.

In use, the stain treatment pad is placed on a surface to be cleaned, such as over a stain or other area to be treated, and the pad heater is placed over the pad. The heating plate warms the pad to add heat energy to the chemical reaction between the surface and the treating chemistry of the pad to promote the stain release, transfer and removal process. During the stain release, transfer and removal process, the combination of the treating chemistry of the pad and the heat energy supplied by the pad heater detaches the stain, on a molecular level, from dye sites on the carpet fibers and from the carpet backing. The stain may be partially destroyed by the process, and any remaining stain can be transferred to the stain treatment pad via absorption and then removed together with the pad when the pad is lifted away from the surface to be cleaned. In some cases, the stain may be fully destroyed by the process. In either case, after the process, the stain is no longer visible on the floor surface to the naked eye of the user.

The weight of the pad heater on the pad can also enhance stain treatment. The pad heater can depress the pad onto the surface to be cleaned, which increases contact between the surface and the entire pad, enhancing the delivery of treating chemistry to promote the stain release, transfer and removal process. For example, the weight of the pad heater on the pad can improve the initial deposition of the treating chemistry onto the surface to be cleaned, and can also help absorb stain residue from deeper within the surface to be cleaned; in the case of carpet, from deeper within the carpet and the carpet backing.

Figure 6:
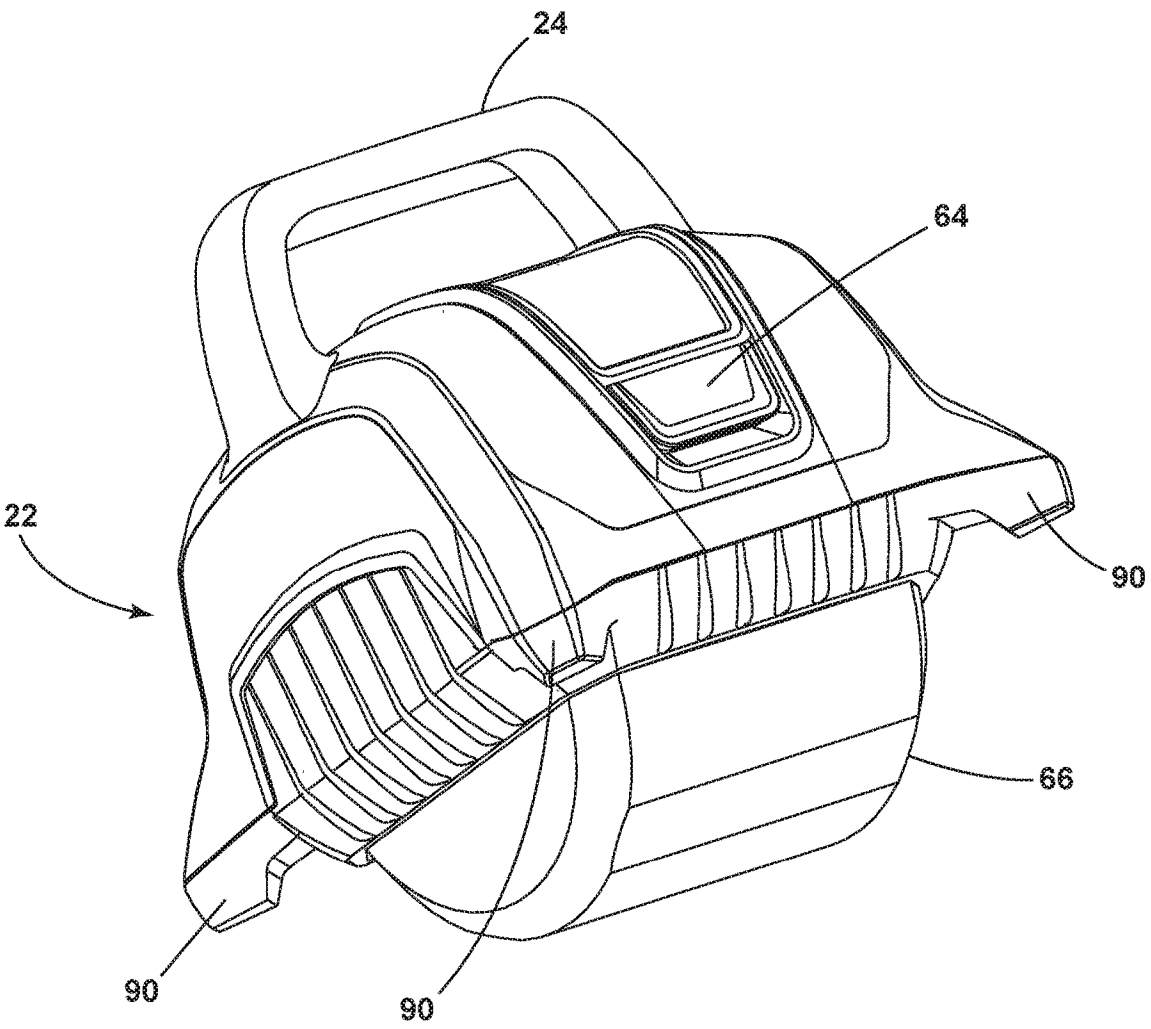
FIG. 6 is a perspective view of an unattended and portable heating device according to a second embodiment of the invention.
Figure 7:
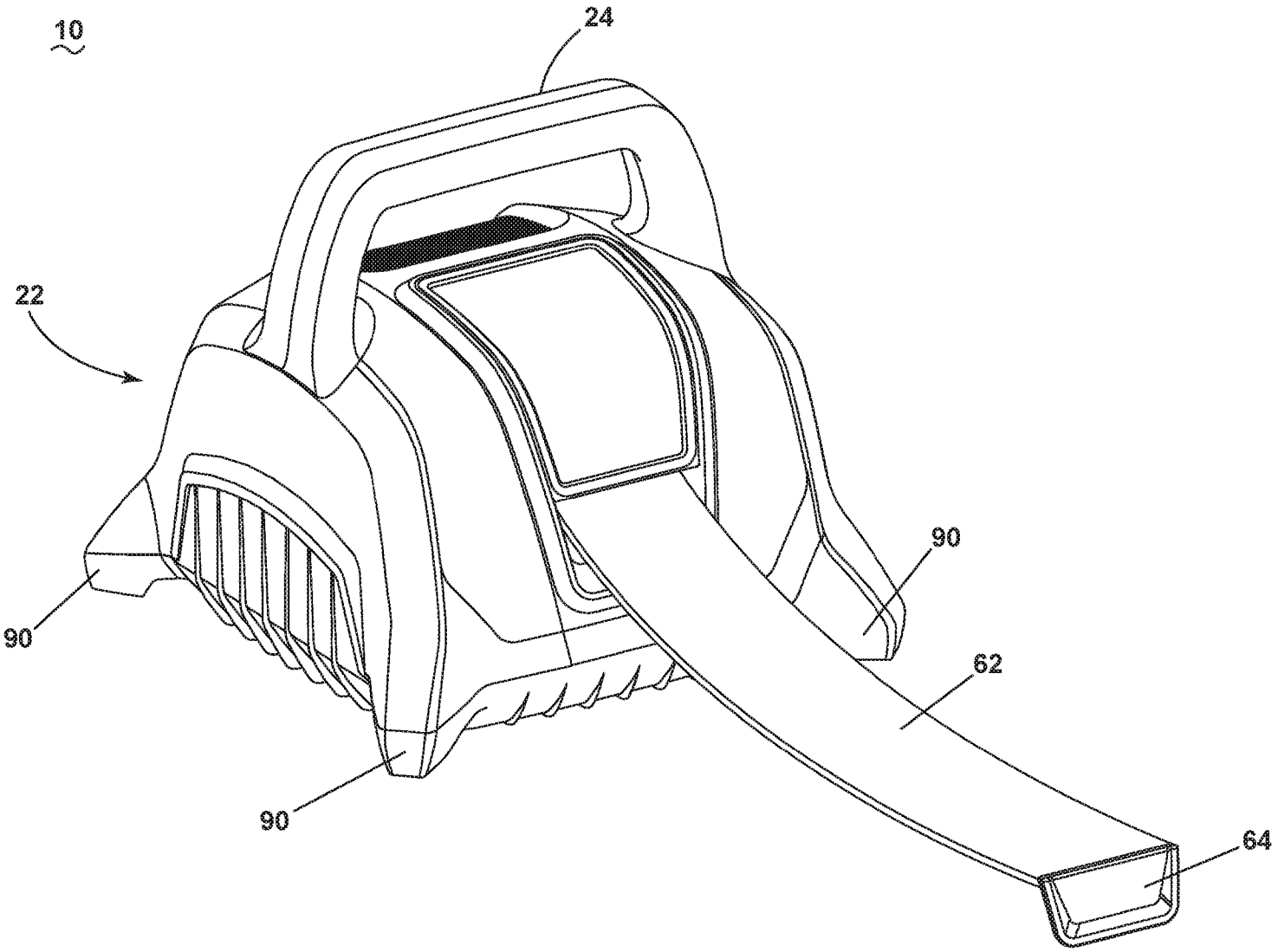
FIG. 7 is a perspective view of the heating device of FIG. 6, showing the heating device during operation.

The pad heater is adapted to be portable, and can be easily carried or conveyed by hand. The hand-carriable pad heater can have a unitary body provided with a carry handle attached, and is small enough to be transported by one user (i.e. one person) to the area to be treated. One embodiment of the pad heater is shown in FIGS. 1-5. Another embodiment is shown in FIGS. 6-7.

The pad heater is adapted to be unattended, and can perform the majority of its operation without the attendance of a user. To treat a stain, a user places a stain treatment pad on the surface, places the pad heater on the pad, and starts a cleaning cycle using a user interface on the pad heater. The pad heater carries out the rest of heating operation on the pad to treat the stain without requiring further action by the user, and can be left along by the user to complete its operation. Sometime after the heating operation is complete, the user can pick up the pad heater and pad from the surface.

Some stains may require more than one treatment; in this case, multiple heating operations can be performed by the pad heater on the same pad, or new pads can be used for each heating operation.

One embodiment of the pad heater 10 is shown in FIGS. 1-5, and can include a heating plate 12 configured to apply heat to a stain treatment pad 14, and a main controller comprising a control circuit 16 and a control panel 18 coupled with the control circuit 16. The main controller is operably coupled with the heating plate 12 for selectively actuating the heating plate. Optionally, the pad heater 10 can include a retractable guard assembly 20.

The pad heater 10 includes a housing 22 defining a unitary portable body that carries the components of the pad heater 10, including, but not limited to, the aforementioned heating plate 12, control circuit 16, control panel 18, and optional guard assembly 20. The housing 22 includes a carry handle 24, and is small enough to be transported by one user (i.e. one person) to the area to be treated.

The unitary portable body defined by the housing 22 can include one or more housing parts. In the illustrated embodiment, the housing 22 includes an upper housing cover 26 that is coupled with a lower housing base 28. The control panel 18 and carry handle 24 can be provided on the housing cover 26 for convenient access by the user. The lower housing base 28 has a generally flat bottom surface 30 that is adapted to rest on a surface to be treated, and includes an opening 32 that is aligned with the heating plate 12 such that the heating plate 12 can engage the stain treatment pad 14.

The heating plate 12 can have a flat heating surface 34 configured to directly engage the stain treatment pad 14 and transfer heat to the stain treatment pad 14. Heat can be transferred to the heating surface 34 by any combination of conduction, convection, and/or radiation. In the illustrated embodiment, the heating plate 12 can comprise a heating element such as a heater tube 36 that conducts heat to the heating surface 34. In yet another configuration, the heat source for the pad heater 10 can comprise a water-activated, self-heating exothermic cartridge forming the heating plate.

The heating plate 12 further includes a temperature controller 38 that receives signals from the main controller via the control panel 18, and controls the heater tube 36, or other heat source, to maintain a preset temperature, and a thermal cutoff 40 that interrupts electric current when heated to a specific temperature, such as a temperature above the preset temperature. For example, the temperature controller 38 can include thermostats in the heating plate 12 that can limit the temperature of the heating plate 12 to 210° F. (about 99° C.) or less. The thermal cutoff 40 can open at a higher temperature (ex: above 210° F.) and re-close when the temperature drops. The thermal cutoff 40 can be configured to automatically reset after the temperature drops, or may be manually resettable.

The pad temperature and temperature of the surface being cleaned will be lower than the temperature of the heating plate 12 due to heat loss. In some tests of the pad heater 10 on carpet, the temperature at the carpet was as low as 158° F. (70° C.) when the heating plate 12 was heated to 210° F. These temperatures are much lower than for a conventional steam mop or steam iron, which are both configured to heat water to its boiling point (100° C./212° F.) to generate steam, and generally apply that steam directly to a surface to be cleaned. Conversely, the heating plate 12 does not generate steam and does not heat the surface to as high a temperature.

Limiting the heating plate 12 to 210° F. (about 99° C.) or less and the carpet temperature to around 158° F. (70° C.) may be preferred in some applications since higher temperatures can cause dye in carpet fibers to be removed or transferred to the pad, along with the stain—resulting in a localized area of fading or lightening on the carpet.

The heating plate 12 can be secured within the housing 22, such as by being secured with the base 28. The heating surface 34 is aligned with the opening 32 in the housing base 28 and that heating surface 34 is flush with the flat bottom surface 30 of the base 28. An insulator 42 can be positioned between the base 28 and the heating plate 12 to prevent the passage of heat outside the heating plate 12.

In one embodiment, the heating plate 12 comprises a square aluminum plate having sides approximately 4½ inches long and a thickness of about ¼ inch. Alternative sizes and shapes for the heating plate 12 are also possible. For example, the size and shape can be dependent on the stain treating pad 14, with the heating plate 12 being dimensioned according to the dimensions of the pad 14. The surface area of the heating plate 12 may be slightly larger than or slightly smaller than the surface area of the pad 14. Alternate heating plate materials can comprise steel, stainless steel, or ceramic, for example.

The pad heater 10 can be powered by a power source. For example, the heating plate 12 can be powered by electricity, via a power cord 44. The power cord 44 can be attached to the housing 22 by a strain relief 46. A cord wrap 48 can be provided on the housing 22 for storing the power cord 44 when the pad heater 10 is not plugged in. Alternatively, the power source for the pad heater 10 can be a rechargeable battery for powering the heating plate 12, and may be cordless.

Figure 3:
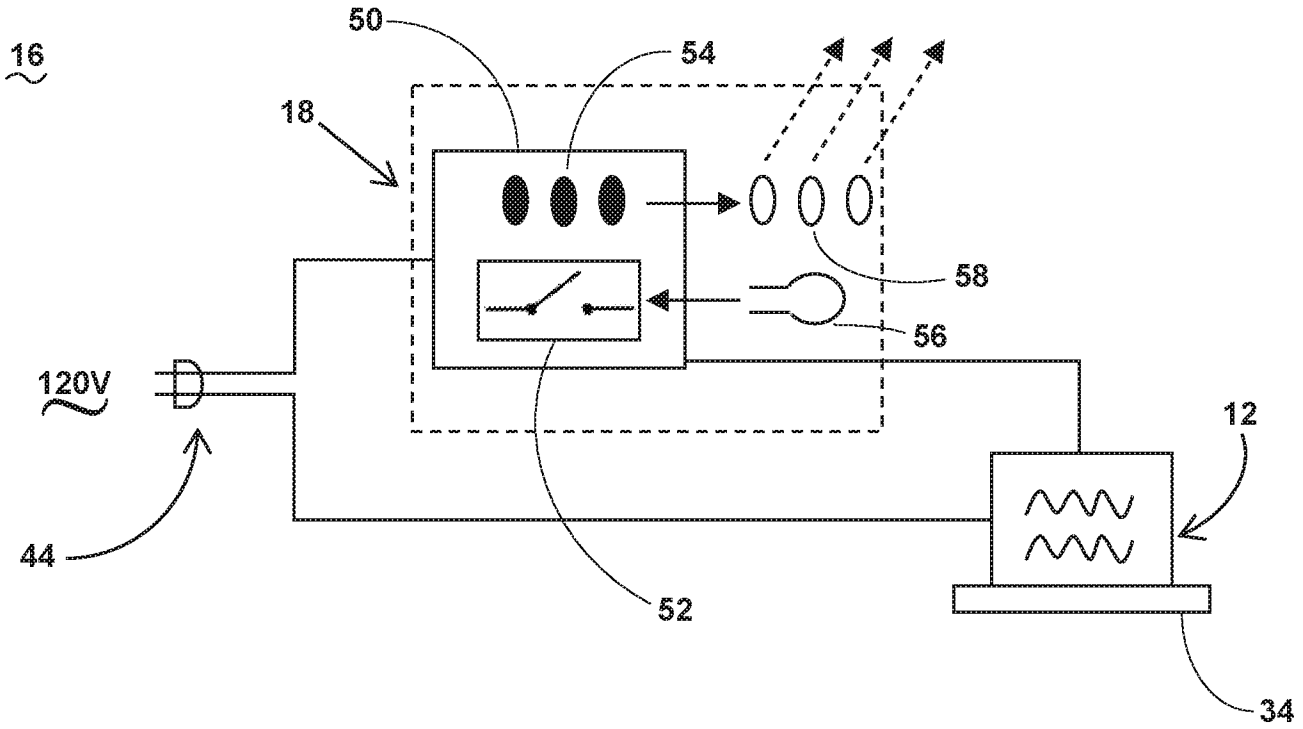
FIG. 3 is a schematic view of a control circuit for the heating device of FIG. 1.

Referring to FIG. 3, the control circuit 16 can comprise a timer circuit or time delay relay circuit, for example which can incorporate various components such as a printed circuit board (PCB) comprising transistors, capacitor(s), diodes, LEDs, and/or integrated circuits. The PCB 50 can be integrated with the control panel 18, and the PCB 50 can include an on/off power switch 52, and at least one indicator 54, such as one or more LEDs, to show when the pad heater 10 and/or heating plate 12 is operating and when the cleaning cycle is complete. A push button 56 or other actuator on the control panel 18 is used to initiate operation of the timer circuit and the cleaning cycle, and will close the power switch 52 when actuated. The PCB 50 is configured to cycle through at least one cleaning cycle when the push button 56 is pressed to close the power switch 52. The control panel 18 can further include at least one opening or window 58 for viewing the at least one indicator 54. The control panel 18 and PCB 50 can be seated in a controller mount 60 on the housing cover 26.

Figure 1:
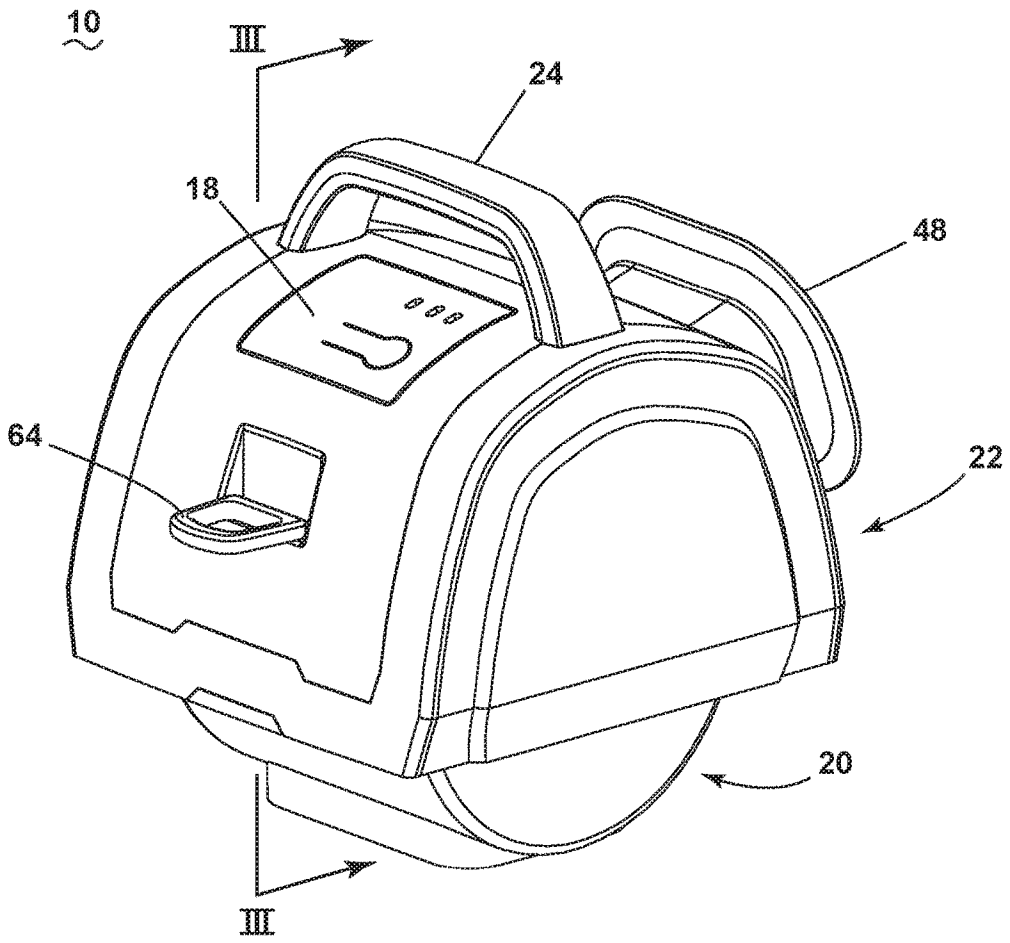
FIG. 1 is a perspective view of an unattended and portable heating device according to a first embodiment of the invention.
Figure 2:
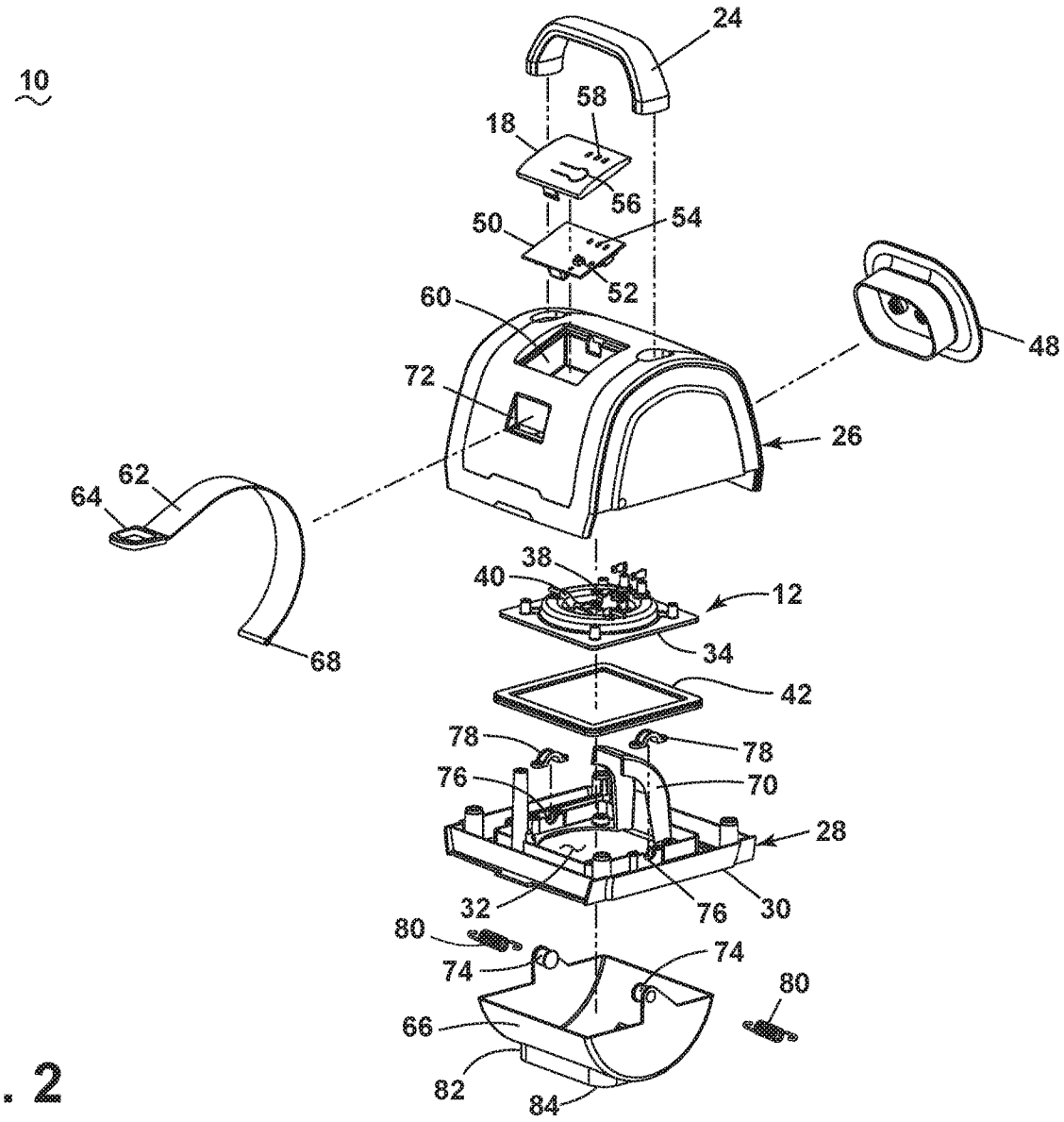
FIG. 2 is an exploded view of the heating device of FIG. 1.
Figure 4:
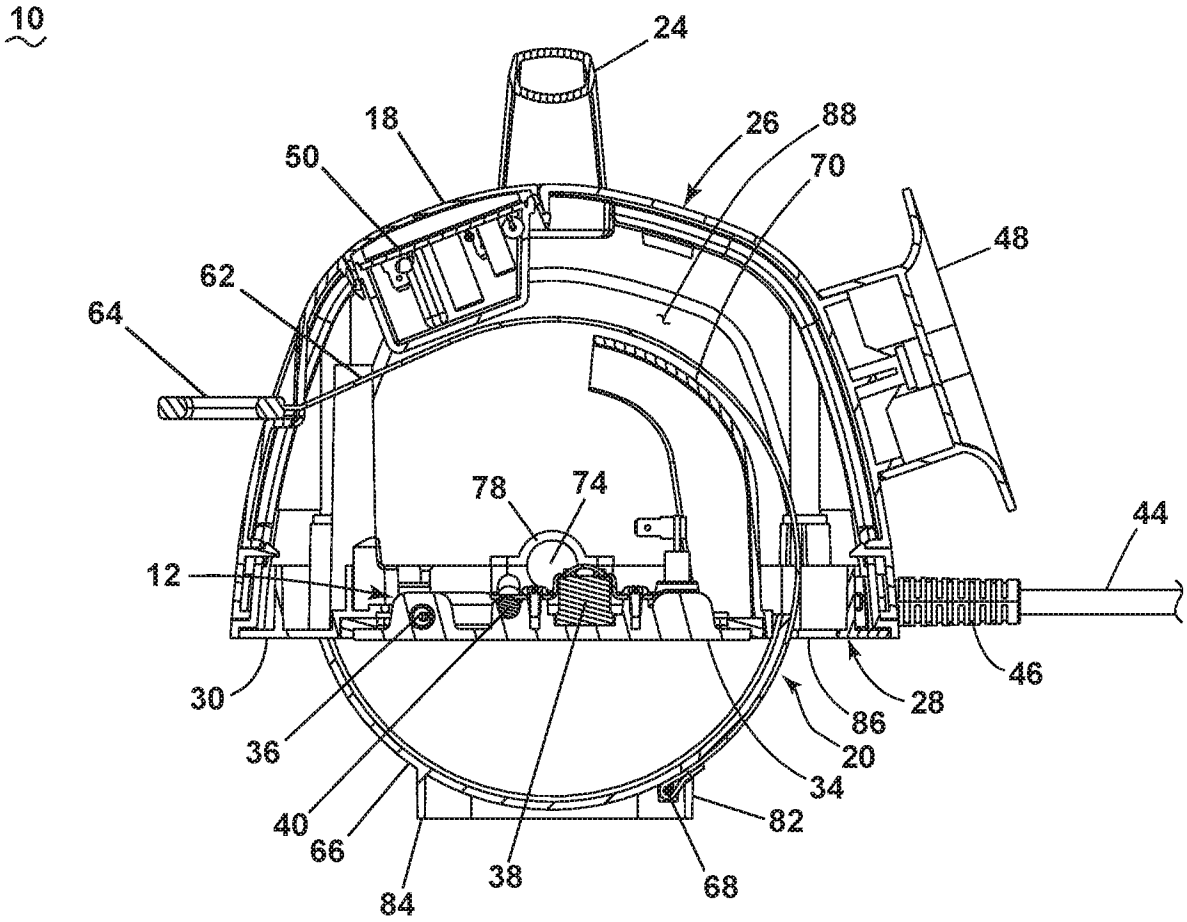
FIG. 4 is a cross-sectional view of the heating device taken through line of FIG. 1.
Figure 5:
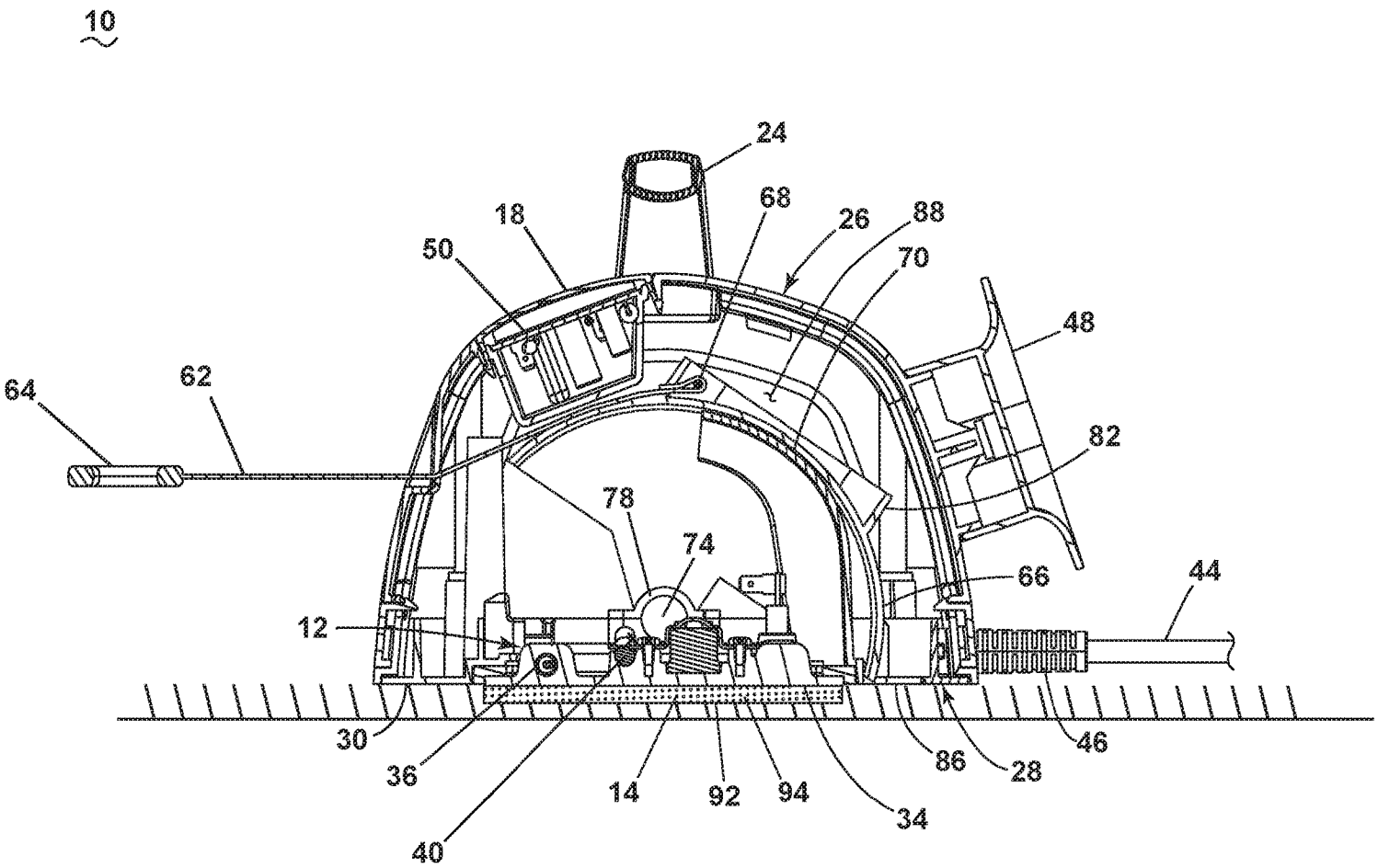
FIG. 5 is a cross-sectional view similar to FIG. 4, showing the heating device during operation.

Referring to FIGS. 2, 4 and 5, the optional retractable, spring biased guard assembly 20 automatically shields the user (and anything else) from the heating plate 12 when the pad heater 10 is lifted away from a surface to be cleaned. A tether 62 having a grip 64, or other user-engageable actuator, is coupled with a retractable cover or guard 66 that is normally biased to cover the heating plate 12 by a biasing mechanism, as shown in FIG. 4. Pulling the tether grip 64 away from the housing 22 retracts the guard 66 and exposes the heating plate 12, as shown in FIG. 5. If the pad heater 10 is picked up by the handle 24 or otherwise moved from the normal operation position, where the heating plate 12 is against a surface as shown in FIG. 5, the guard 66 will automatically cover the heating plate 12.

The tether 62 can be coupled to the rotatable guard 66 by a pin 68 or other suitable attachment and can follow a guard guide 70 provided within the housing 22. The guard guide 70 can project upwardly from one side of the base 28 and curve toward the center of the housing 22. A tether opening 72 for the tether 62 can be provided in the housing cover 26, on a side opposite that of the guard guide 70. The tether 62 extends between a first end attached to the guard 66 by the pin 68, into the housing 22 and around the guard guide 70, and out of the housing 22 at the tether opening 72 to a second end attached to the grip 64.

The guard 66 can be rotatably mounted to the housing 22 of the pad heater 10. In the illustrated embodiment, the rotatable coupling between the guard 66 and housing 22 includes rotational shafts 74 provided on the guard 66 that are received in cradles 76 provided on the base 28. Guard mounts 78 are attached to the cradles 76 over the rotational shafts 74 to affix the guard 66 to the base 28 for rotational movement about an axis defined by the shafts 74.

The biasing mechanism can be one or more torsion springs 80 mounted between the rotational shafts 74 of the guard 66 and the base 28. As illustrated, torsion springs 80 are provided for each rotational shaft 74. Alternatively, the biasing mechanism can be a constant force spring coupled between the guard 66 and the housing 22.

The guard 66 can include a support portion 82 on which the pad heater 10 can rest, as shown in FIG. 3. The support portion can include a substantially flat base 84 that can reduce tipping of the pad heater 10. An opening 86 in the base 28 is sized so that the entire guard 66, including the support portion 82, can retract through the opening 86 and into an interior 88 of the housing 22, as shown in FIG. 5.

Another embodiment of the pad heater 10 is shown in FIGS. 6-7, and can include at least some or all of the features described above for the embodiment shown in FIGS. 1-5. The second embodiment of the pad heater 10 includes outboard feet 90 on the lower portion of the housing 22, rather than a support portion on the guard 66, which may improve balance and reduce tipping of the pad heater 10. When the retractable guard 66 is closed, as shown in FIG. 6, the pad heater 10 can securely rest in a tipped orientation on two of the feet 90 and the guard 66. When the retractable guard 66 is open, as shown in FIG. 7, the pad heater 10 can securely rest on all of the feet 90.

It is noted that the embodiments of the pad heater 10 shown herein are tankless, and do not include an on-board supply of cleaning fluid or fluid delivery system. This can reduce the weight, size, and cost of the pad heater 10 in comparison to other conventional cleaning apparatus directed at stain treatment, making the portable pad heater 10 light-weight, compact, portable and less expensive.

The stain treatment pad 14 for use with any embodiments of the pad heater 10 disclosed herein can include a moisture-absorbent pad that can take up or receive, by chemical or molecular action, moisture and stain particles from the surface to be cleaned. The pad 14 is schematically represented in FIG. 5, and can comprise a substrate material 92 pre-wetted with a cleaning composition or treating chemistry 94. The substrate material 92 can comprise single or multiple layers and a variety of materials, such as cellulose, cellulose fiber, cellulose fluff, superabsorbent polymer (SAP), micro-fiber, terry cloth, non-woven fiber sheets and combinations thereof. Additionally, optional top and/or bottom layers of the substrate material 92 can comprise polyethylene, polypropylene, polyester, or combinations thereof and can be micro-perforated for distributing and absorbing fluids to and from the absorbent substrate. The stain treatment pad 14 for use with any embodiments of the pad heater 10 disclosed herein can be individually sealed prior to use, such as in a foil package.

The pad 14 can be pre-wetted by a manufacturing process whereby dry pads of substrate material 92 are inserted into unsealed foil packages having an upper open end. A predetermined volume of liquid is added to the open package to saturate the dry pad. After the liquid filling operation, the foil package is sealed by a conventional heat seal process.

In one embodiment, the pad 14 can be pre-wetted with a mixture of water, hydrogen peroxide, and sodium lauryl sulfate (SLS). In other embodiment of the pad, SLS can be replaced by a substitute comprising other anionic surfactants or subsets thereof, such as sodium "R" sulfate salts, where R=C8-C18, or alternatively, replacing the sodium ion with ammonium, magnesium, or triethanolamine (TEA), i.e. ammonium lauryl sulfate (ALS), magnesium lauryl sulfate, or TEA-lauryl sulfate. A fragrance can be included in any embodiment of the cleaning composition described herein.

Some examples of suitable stain treatment pads for use with the various embodiments of the pad heater 10 disclosed herein can be used are disclosed in U.S. Patent Application Publication No. 2013/0318725, published Dec. 5, 2013, which is incorporated herein by reference in its entirety.

In another embodiment, the pad heater 10 can be used with the BISSELL Stomp'n Go® Pad for Carpet Stain Removal (Model 96Q9 W).

In another embodiment, a dry or unwetted pad of substrate material 92 can be wetted with treating chemistry 94 by the user just prior to use of the pad heater 10. For example, an unwetted pad can be placed over a stain, and a treating chemistry can be sprayed or otherwise applied to the pad prior to placing the pad heater over the stain. The treating chemistry can also be applied to the pad prior to placing it on the stain.

Figure 8:
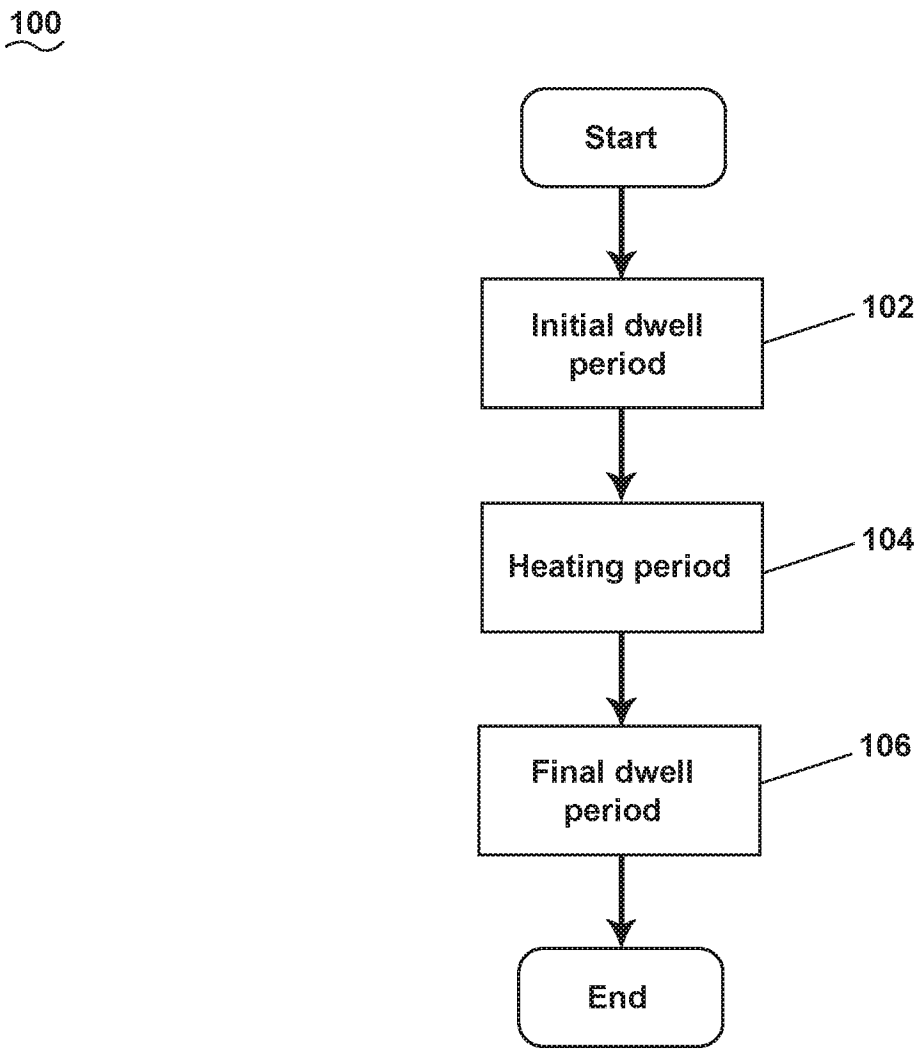
FIG. 8 is a flow chart illustrating a cleaning cycle for an unattended and portable heating device.
Figure 9A:
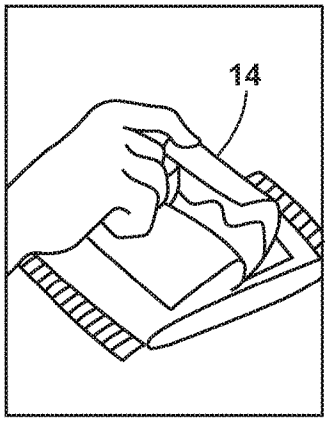
FIGS. 9A-9J illustrate a method of treating a stain on a floor surface using an unattended and portable heating device and a stain treatment pad.
Figure 9B:
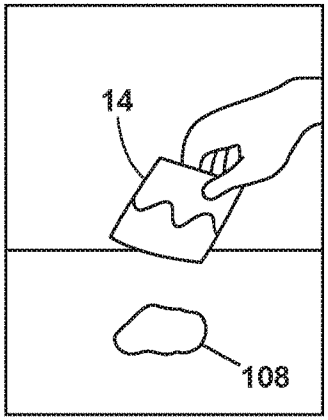
Figure 9C:
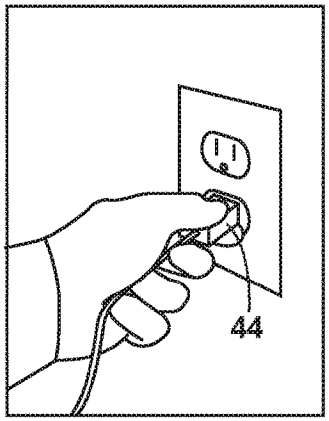
Figure 9D:
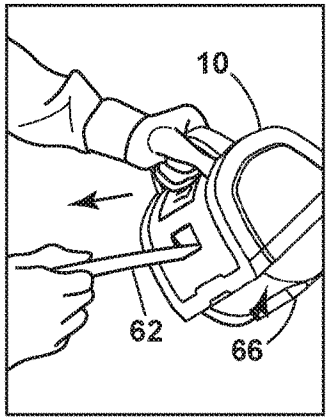
Figure 9E:
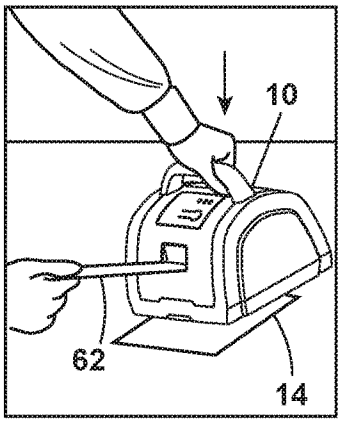
Figure 9F:
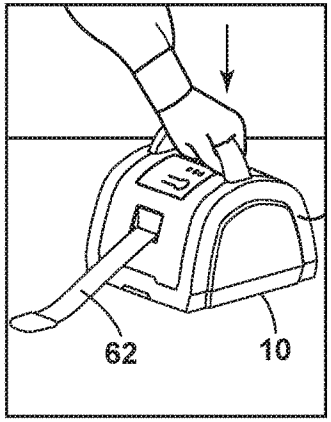
Figure 9G:
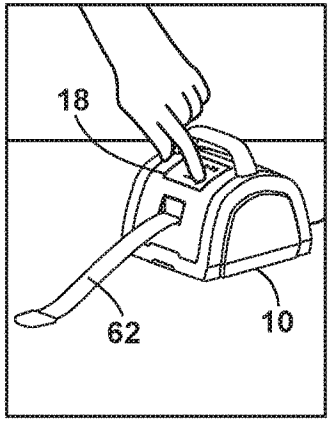
Figure 9H:
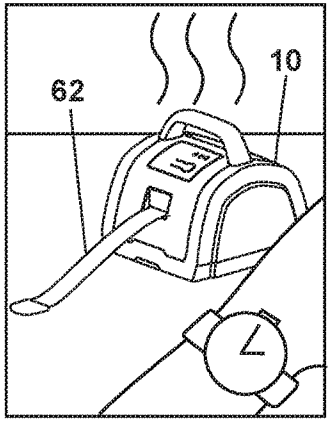
Figure 9J:
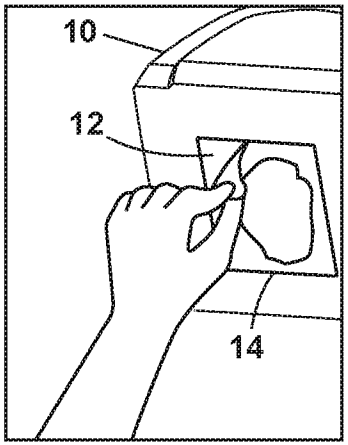
Figure 9I:
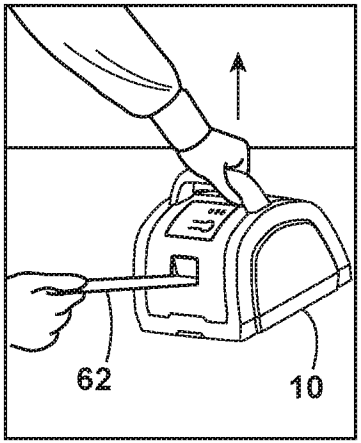

With reference to FIG. 8, a cleaning cycle 100 of any embodiments of the pad heater 10 disclosed herein may be selected using the control panel 18 on the pad heater 10 and can include the following timing sequence: an initial dwell period 102 (ex: 5 minutes) in which the pre-wetted pad 14 dwells on the surface to be cleaned and the heating plate 12 is "off" or de-actuated; a heating period 104 (ex: 1 minute) in which the heating plate 12 is "on" or actuated, and heat energy is added to the pad 14; and a final dwell period 106 (ex: 5 minutes) in which the heating plate 12 is "off" but contains a decreasing amount of residual heat. The total cycle time is the initial dwell period 102 plus the heating period 104 plus the final dwell period 106 (ex: 11 minutes).

Upon initiating the cycle 100, the timer circuit opens, which disconnects power to the heating plate 12 for a pre-determined dwell period at 102 while the pre-wetted pad 14 dwells on the surface to be cleaned and saturates the stain with treating chemistry. During this period, the heating plate 12 is "off" and the pad heater 10 indicates a cleaning cycle is in process, for example by illuminating one of the LED indicators 54 on the control panel 18. Also during this period, the weight of the pad heater on the pad can increase the amount of treating chemistry deposited from the pad 14 onto the surface to be cleaned.

After the initial dwell period 102, the timer circuit closes and connects power to a heating element within the heating plate 12, for example the heater tube 36. The heating plate 12 is energized for the pre-determined heating period at 104 to raise the temperature of the heating plate 12 to a predetermined value. Heat energy is added to the stain treatment pad 14 via the heating plate 12 at a 210° F. or less thermostat setting.

After the heating period 104, the timer circuit opens and disconnects power to the heating plate 12. Power to the heating plate 12 remains disconnected for a final, predetermined dwell period at 106 while residual heat from the heating plate 12 interacts with the treating chemistry in the pad 14 and on the surface to be cleaned to solubilize and transfer the stain from the surface being cleaned (e.g. carpet fibers) to the pad 14. During this period, the pad heater 10 indicates a cleaning cycle is still in process, for example by illuminating one of the LED indicators 54 on the control panel 18.

At the end of the cleaning cycle 100, an indicator on the control panel 18 can show that the cycle is "complete." For example, after the final dwell period 106, the timer circuit can supply power to one of the LED indicators 54 on the control panel 18 that illuminates to alert a user that the cleaning cycle 100 is complete.

It is noted that the stain release, transfer and removal process may occur during any period or periods of the cleaning cycle 100. For example, stain release and transfer may begin during the initial dwell period 102, or not until the heating period 104. Also during the cleaning cycle 100, the weight of the pad heater on the pad can help absorb stain residue from deeper within the surface to be cleaned; in the case of carpet, from deeper within the carpet and the carpet backing.

It is also noted that the exemplary times indicated in parenthesis in combination with the indicated temperature has been shown to maximize cleaning without damaging carpet dyes, which is especially important on aged carpet which is more prone to fading when treated with comparatively higher temperatures for a longer period of time.

The disclosed intervals—the initial 5 minute dwell period, followed by 1 minute of energizing the heat plate, followed by a final 5 minute dwell period—can be adjusted and optimized depending on characteristics of the surface to be cleaned and details of the particular stain. Multiple cleaning cycles may be provided, and the user may be able to select between different cycles based on the stain to be treated and/or the stain treatment pad to be used.

A method of treating a stain on a floor surface using any embodiments of the pad heater 10 and stain treatment pad 14 disclosed herein can include the steps shown in FIGS. 9A-9J. The specific sequence of steps discussed is for illustrative purposes only and does not limit the method unless otherwise noted, as it is understood that the steps may proceed in a different logical order, additional or intervening steps may be included, or described steps may be divided into multiple steps, without detracting from the invention.

To treat a stain 108, (a) the user opens a package containing a pre-wetted stain treatment pad 14, and (b) places the pad 14 directly on the stain 108. The user (c) plugs in the power cord 44 of the pad heater 10, (d) pulls the tether 62 to retract the guard 66 and expose the heating plate 12, and (e) places the pad heater 10 on the pad 14, with the heating plate 12 in direct contact with the top of the pad 14, while still pulling the tether 62 taut. With the pad heater 10 on the pad 14, the user (f) releases the tether 62 and (g) selects a cleaning cycle via the control panel 18, which starts a heating operation. The pad heater 10 carries out the rest of heating operation on the pad 14 to treat the stain without requiring further action by the user (h). The heating plate 12 warms the pad 14 to add heat energy to the chemical reaction between the surface and the treating chemistry of the pad 14 to promote the stain release, transfer and removal process. After the heating operation is complete, the user can (i) pick up the pad heater 10 and pad 14 from the surface. The wet pad 14 may stick to the bottom of the pad heater 10 due to surface tension. The user may pull the tether 62 taut while lifting the pad heater 10 off the surface to avoid the guard 66 closing over the used pad 14. The pad 14 can (j) be peeled off the heating plate 12 and disposed of, or saved for another cleaning cycle.

There are several advantages of the present disclosure arising from the various features of the apparatuses, systems, and methods described herein. For example, the embodiments of the invention described herein provides an unattended and portable heating device that is configured to heat a pre-wetted stain treatment pad to remove tough, set-in stains from carpet and rugs. Using a prior art steam mop which operates at 212° F. (100° C.) or more or a clothing steam iron which operates at 356-428° F. (180-220° C.) would not work as well as the apparatuses, systems, and methods described herein, because the temperatures at which these devices operate are too hot, which can actually release factory dyes from carpet and fade or "bleach" carpet.

Another advantage of the present disclosure is that some embodiments the apparatuses, systems, and methods described herein provides an unattended and portable heating device with a retractable guard feature that automatically shields the user and anything else from the heating plate when the device is lifted away from a surface to be cleaned.

The described system and method has further been found to be especially effective on removing stains containing various synthetic dyes such as FD&C Red #40, Blue #1, and Yellow #6, which are commonly used in foods and beverages stains. These dye-based stains are especially difficult to remove from older, worn carpets because over time, stain resistant coatings such as Scotchgard™ or Teflon™, which are typically applied to carpet fibers after the factory dyeing process, can wear away rendering the carpet fibers vulnerable to receiving other dyes and becoming permanently stained. The absence of a protective coating exposes dye sites on carpet fibers, which are charged areas on the fibers that attract oppositely charged dyes. For example, positively charged dye sites on a carpet fiber can attract negatively charged (anionic) dyes, such as acid dyes. Carpet protector coatings block stains because they are negatively charged resins that function like colorless dyes by occupying the positively charged dye sites on a carpet fiber, and thereby block anionic dyes from attaching to dye sites. When protective coatings wear away, exposed dye sites on the carpet fibers can readily absorb dyes from food, drinks and waste similar to the manner in which carpets are originally dyed. It is very difficult to preferentially remove the unwanted dye while leaving behind the original dye in the fibers.

The system and method disclosed herein is designed to safely clean these difficult stains without damaging or lightening the original dyed color of the carpet fibers. It is within the scope of the invention to treat stains containing various other synthetic and/or natural food dyes in addition to those specifically listed above.

To the extent not already described, the different features and structures of the embodiments may be used in combination with each other as desired, or may be used separately. That one pad heater is illustrated herein as having all of the features shown does not mean that all of these features must be used in combination, but rather is done so here for brevity of description. Thus, the various features of the different embodiments may be mixed and matched in various configurations as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A cleaning system comprising:

a stain treatment pad wetted with a liquid treating chemistry; and a portable, unattended heating device comprising:

a housing defining a unitary portable body;

a heating plate adapted to heat to a temperature less than the boiling point of water, wherein the heating plate is carried by the housing and includes a heating surface adapted to selectively rest on the stain treatment pad and when the heating surface rests on the stain treatment pad, heat can be transferred to the stain treatment pad;

a retractable heating plate guard assembly moveable between an opened position wherein the heating plate is accessible and a closed position wherein the heating plate is shielded; and a main controller operably coupled with the heating plate, the main controller comprising a control circuit and a control panel operably coupled with the control circuit and provided on the housing for access by a user to select a cleaning cycle wherein the main controller is configured to actuate the heating plate to heat to a temperature less than the boiling point of water.

2. The cleaning system of claim 1 wherein the housing comprises a handle on an upper portion thereof, opposite the heating plate.

3. The cleaning system of claim 1 wherein the heating plate comprises a flat heating surface.

4. The cleaning system of claim 3, wherein the housing comprises a base having a generally flat bottom, and includes an opening that is aligned with the heating plate, and wherein the heating plate is flush with the generally flat bottom of the base.

5. The cleaning system of claim 3, wherein the heating plate comprises a heater tube in heat conductive contact with the flat heating surface.

6. The cleaning system of claim 1 wherein the heating plate further comprises a temperature controller operably coupled with the main controller and configured to receive signals from the control panel to maintain a preset temperature less than the boiling point of water.

7. The cleaning system of claim 6, wherein the heating plate further comprises a thermal cutoff that interrupts electric current when heated to a temperature above the preset temperature.

8. The cleaning system of claim 6, wherein the preset temperature is 210° F.

9. The cleaning system of claim 1 wherein the retractable heating plate guard assembly comprises a guard cover and a biasing mechanism that biases the guard cover to the closed position.

10. The cleaning system of claim 9 wherein the heating plate guard assembly further comprises a tether coupled with the guard cover and having a grip accessible from exterior of the heating device.

11. The cleaning system of claim 10 wherein the portable, unattended heating device further comprises a guard guide provided within the housing, and wherein the tether extends between a first end attached to the guard cover, into the housing and around the guard guide, and out of the housing to a second end attached to the grip.

12. The cleaning system of claim 11 wherein the guard guide provided within the housing projects upwardly on one side of the heating plate and curves toward the center of the housing.

13. The cleaning system of claim 9 wherein the guard cover is rotatably mounted to the housing by a rotatable coupling between the guard cover and the housing.

14. The cleaning system of claim 13 wherein the biasing mechanism comprises at least one torsion spring mounted between the guard cover and the housing.

15. The cleaning system of claim 9 wherein the guard cover comprises a support portion having a substantially flat base on which the heating device can rest.

16. The cleaning system of claim 9 wherein the housing defines an interior and comprises an opening sized to receive the guard cover through the opening and into the interior of the housing.

17. The cleaning system of claim 1 wherein the housing comprises a lower housing base and an upper housing cover that is coupled with the lower housing base, wherein the lower housing base has a bottom surface that is adapted to rest on a surface to be treated, and includes an opening that is aligned with the heating plate.

18. A cleaning system comprising:

a portable, unattended heating device comprising:

a housing defining a unitary portable body;

a heating plate adapted to heat to a temperature less than the boiling point of water, wherein the heating plate is carried by the housing and forms at least a portion of a bottom surface of the housing that is adapted to selectively rest on and heat a stain treatment pad;

a retractable heating plate guard assembly moveable between an opened position wherein the heating plate is accessible and a closed position wherein the heating plate is shielded; and a controller operably coupled with the heating plate, and comprising a control circuit and a control panel operably coupled with the control circuit and provided on the housing for access by a user to select a cleaning cycle;

wherein the controller is configured to actuate the heating plate to heat to a temperature less than the boiling point of water.

19. The cleaning system of claim 18, further comprising multiple stain treatment pads wetted with a liquid treating chemistry.

* * * * *